US005749031A

United States Patent [19]

Miwa et al.

[11] Patent Number: 5,749,031

[45] Date of Patent: May 5, 1998

[54] DEVELOPING APPARATUS IN USE WITH AN IMAGE FORMING APPARATUS

[75] Inventors: Tadashi Miwa; Hidehiro Kanda; Isao Matsuoka; Toru Makino; Wang Zhoa Yan; Ryoko Yoshikawa; Akira Tai; Naoto Tokutake; Masahiro Shigetomi, all of Hachioji, Japan

[73] Assignee: Konica Corporation, Japan

[21] Appl. No.: 670,394

[22] Filed: Jun. 25, 1996

[30] Foreign Application Priority Data

Jun. 29, 1995 [JP] Japan ..... 7-163808

[51] Int. Cl.[6] ..... G03G 15/06

[52] U.S. Cl. ..... 399/228; 399/236; 464/160

[58] Field of Search ..... 399/276, 228, 399/236; 764/1, 4, 160, 157, 93

[56] References Cited

U.S. PATENT DOCUMENTS 5,099,278 3/1992 Sato ..... 355/200

5,303,004 4/1994 Maruyama et al. ..... 355/200

5,440,377 8/1995 Izawa et al. ..... 355/245

*Primary Examiner*—Joan H. Pendegrass

*Assistant Examiner*—Quana Grainger

*Attorney, Agent, or Firm*—Jordan B. Bierman; Bierman, Muserlian and Lucas LLP

[57] ABSTRACT

A developer in use with an image forming apparatus. The developer includes: a developing sleeve which rotates and holds toner on itself so as to develop a latent image on a photoreceptor with the toner; a driving motor for generating a rotational driving force; a drive transmission for transmitting the rotational driving force of the driving motor to the developing cartridge in which the drive transmission has a transmitting state and an untransmitting state; and a shock easing controller or member for easing a shock of transmission of the rotational driving force to the developing sleeve in the transmitting state, in which the shock easing controller or member is provided in at least one of the driving means and the drive transmission means.

7 Claims, 11 Drawing Sheets

PHOTORECEPTOR DRUM RATE OF ROTATION
0
1
2
3
4

CHARDING

EXPOSURE
Y
M
C
B

Y CLUTCH
LEADING EDGE OF Y RECORDING

Y DEVELOPING UNIT

M CLUTCH
LEADING EDGE OF M RECORDING

M DEVELOPING UNIT

C CLUTCH
LEADING EDGE OF C RECORDING

C DEVELOPING UNIT

BK CLUTCH
LEADING EDGE OF BK RECORDING

BK DEVELOPING UNIT

CLEANING

DEVELOPING MOTOR (AC)

SWITCHING MOTOR

DEVELOPING MOTOR (DC)

DEVELOPING APPARATUS IN USE WITH AN IMAGE FORMING APPARATUS

BACKGROUND OF THE INVENTION

The present invention relates to a developing apparatus in use with an image forming apparatus wherein driving power for rotations is transmitted from the main body of the image forming apparatus to a developing cartridge so that the developing apparatus may conduct development, and in particular, to a technology for reducing transmission fluctuation such as a shock or a vibration caused in the course of transmission of the driving power for rotation.

Heretofore, in the developing apparatus of an image forming apparatus, there is arranged a developing cartridge equipped with a developing sleeve for forming thereon a magnetic brush, a stirring screw that supplies an appropriate amount of charging while stirring and conveying toner stored therein, and with a driving gear train which drives both the sleeve and the stirring screw mentioned above.

Generally, a developing cartridge is composed of 4 developing units for yellow (Y), magenta (M), cyan (C) and black (Bk) for multi-color development, and each developing unit is equipped with a clutch mechanism through which the transmission of driving power for rotation from the main body of the image forming apparatus is switched in succession in the developing units. Further, on each of both ends of the developing sleeve of each developing unit, there is provided a stopper roll having an outside diameter greater than that of the developing sleeve.

In such an image forming apparatus, under the state that a developing cartridge is installed in the main body of the apparatus, each developing unit is urged against a photoreceptor drum by a pressure spring provided on a developing cartridge. However, the stopper rolls at both ends of the developing sleeve come in contact with the photoreceptor drum against the pressure force, and thereby a gap between the photoreceptor drum and the developing sleeve is regulated so that an appropriate amount of charging toner may be moved from a magnetic brush on the developing sleeve to the surface of a latent image on the photoreceptor drum through an electric field between the photoreceptor drum and the developing sleeve.

On the other hand, when the developing cartridge is mounted on the main body of the apparatus, a driving transmission path is formed by engagement between the developing cartridge and coupling gears on the part of the apparatus main body, and driving force of a driving motor provided on the part of the apparatus main body drives a driving gear train of the developing unit so that a stirring roller and a developing sleeve in the developing unit are rotated. Thus, multi-color development is performed by operating each color developing unit from the driving motor on the part of the apparatus main body through a clutch mechanism arranged in the coupling gears.

Namely, after completion of development for a Y color component, a photoreceptor drum is rotated and a tip portion for recording is subjected to exposure and development for an M color component, without performing steps of transfer, cleaning and neutralizing. After that, the same procedures are conducted for a C color component an a Bk color component, and developing procedures for components of 4 colors in total are conducted on the photoreceptor drum.

On the conventional image forming apparatus, however, driving power for rotation from one driving motor is distributed to each developing unit for each color component through switching of a clutch mechanism. Therefore, when a developing unit is started in the course of image forming, a shock caused by the start of driving transmission for the developing unit is transmitted to a photoreceptor drum through stopper rolls at both ends of the developing sleeve, resulting in occurrence of uneven rotation of the photoreceptor drum. This greatly affects the exposure step wherein sub-scanning is performed at high accuracy of 40–80 μm width, resulting in the first problem that deterioration in image quality in the form of uneven pitch is caused in the sub-scanning direction. Further, even in the case of black and white development wherein only one driving motor drives both a photoreceptor drum and a developing unit, the same problem as in the foregoing is to be caused because a developing unit is started by switching of a clutch mechanism.

To the contrary, it is easily considered that each developing unit is provided with a driving source separately from a photoreceptor drum without providing a clutch mechanism so that the start of the developing unit may be controlled. However, this causes another problem of a higher cost and a larger size of an apparatus.

In addition, especially when a developing cartridge is of a type to be attached on and detached from the apparatus main body freely, a portion of a pair of coupling gears for driving transmission causes unnecessary stationary vibration in the course of driving transmission at a boundary area between the apparatus main body and the developing cartridge, where rigidity of a driving transmission system is insufficient, and the vibration is transmitted to the photoreceptor drum through stopper rolls in the same manner as in the aforesaid shock at the start of driving transmission, resulting in the second problem that deterioration of image quality caused by uneven pitch in the sub-scanning direction is generated.

For the second problem mentioned above, it is possible to consider to use a material with high rigidity which can enhance accuracy of a distance between axes of a pair of coupling gears which face each other when a developing cartridge is mounted on the apparatus main body, or to create a structure with high rigidity. However, these ideas increase a cost of the apparatus and make the structure of the apparatus to be complicated, and no fundamental solution has been found out.

Further, the first problem and the second problem mentioned above are more serious problems in a digital image forming apparatus as in examples of the invention, compared with a conventional analogue image forming apparatus.

Namely, in the analogue machine, image density difference on an original is grasped integrally by a slit of 8–10 mm width, and even when a photoreceptor or the like is driven unevenly, the unevenness is averaged (smoothed) and it hardly appears as density unevenness of an image formed on a photoreceptor. In the digital machine, on the other hand, information of an original read as a digital image in written on a photoreceptor by a laser beam line by line. Therefore, uneven driving of the photoreceptor appears as a variation of a line distance, as it is. Since this variation of line distances represents an image density difference, higher accuracy is required for uneven rotation of a photoreceptor drum, compared with the analogue machine.

Since the digital machine is capable of reproducing images with high resolution theoretically, compared with an analogue machine, rotation control at high accuracy is required for a photoreceptor from the viewpoint of the relative relation between spatial frequency and density unevenness level.

SUMMARY OF THE INVENTION

The present invention has been achieved in view of the problems above, and its object is to offer a developing apparatus in use with an image forming apparatus capable of reducing transmission variation such as a shock and a vibration caused in the course of transmission of driving for rotation and thereby of preventing deterioration of image quality, without changing the structure of the apparatus to be larger and without increasing the cost thereof.

Accordingly, the invention is to solve the problems in the past mentioned above, and it is represented by a developing apparatus in use with an image forming apparatus which includes: a developing sleeve which rotates and holds toner on itself so as to develop a latent image on an image carrier with the toner; a driving means for generating a rotational driving force; a drive transmission means for transmitting the rotational driving force of the driving means to the developing cartridge in which the drive transmission means has a transmitting state and an untransmitting state; and a shock easing means for easing a shock of transmission of the rotational driving force to the developing sleeve in the transmitting state, in which the shock easing means is provided in at least one of the driving means and the drive transmission means.

Another example of the invention is represented by a developing apparatus of an image forming apparatus visualizing a latent image formed on the image carrier while the developing apparatus has a predetermined distance to the image carrier, in which there are provided a developing cartridge that is structured to be attached on and detached from the apparatus main body freely and conducts development of the latent image by rotating a developing sleeve which holds toner, a driving means that is provided independently from another driving means for the image carrier and drives the driving cartridge, a drive transmission means that transmits a rotational driving force of the driving means to the developing cartridge, and a shock easing means that controlls the driving means so that the rotational driving force transmitted by the drive transmission means is gradually increased from the low speed to the predetermined speed and thereby eases a shock generated at the start of rotation drive transmission to the developing cartridge.

It is also possible to make an arrangement so that rotation of the developing sleeve transmitted through the driving transmitting means reaches the predetermined speed when the leading portion of the latent image recorded on the image carrier arrives at the developing position of the developing cartridge.

Further, it is also possible to make an arrangement in which the driving means is represented by an AC motor to drive the developing sleeve, the driving transmitting means is equipped with a clutch mechanism for switching transmission of the rotational driving force of AC developing motor to the developing cartridge between a transmitting state and an untransmitting state, the shock easing means turns the AC motor off prior to switching of the transmission of the rotational driving force to the transmitting state, and turns the AC motor on after switching of the transmission of the rotational driving force to the transmitting state so that the rotation speed of the AC motor is increased gradually from the low speed to the predetermined speed.

Further, it is also possible to make an arrangement in which the driving means mentioned above is represented by an DC motor to drive the developing sleeve, the driving transmitting means is equipped with a clutch mechanism for switching transmission of the rotational driving force of DC developing motor to the developing cartridge between a transmitting state and an untransmitting state, the shock easing means turns off the DC motor prior to switching of the transmission of the rotational driving force to the transmitting state, and increases gradually the speed of the DC developing motor to the predetermined speed after switching of the transmission of the rotational driving force to the transmitting state.

Another example of the invention is represented by a developing apparatus of an image forming apparatus that visualizes a latent image formed on an image carrier while being regulated to be away by a predetermined distance from the rotating image carrier, wherein there are provided a developing cartridge that develops while rotating a developing sleeve structured to be attached on and detached from the apparatus main body freely and has toner, a driving means provided so that it may rotate the aforesaid developing cartridge provided on the apparatus main body, a driving transmitting means that transmits rotation of the driving means to the developing cartridge, and a shock easing member that is located on the transmission path of the rotational driving force and at the downstream side of the transmission variation generating source and eases variation in rotational driving force transmitted by the driving transmitting means.

Another example of the invention is represented by a developing apparatus of an image forming apparatus that visualizes a latent image formed on an image carrier while the developing apparatus has a predetermined distance to the rotating image carrier, in which there are provided a developing cartridge that develops while rotating a developing sleeve structured to be attached on and detached from the apparatus main body and carries toner, a driving means provided independently from the driving means for the image carrier, a driving transmitting means that transmits rotation of the driving means to the developing sleeve, a shock easing means that eases shock caused at the start of transmitting rotational driving force to the developing cartridge by increasing gradually the speed of rotation transmitted by the driving transmitting means from the low speed to the predetermined speed, and a shock easing member that is located on the transmission path of the rotational driving force and at the downstream side of the transmission variation generating source and eases variation in rotational driving force transmitted by the driving transmitting means.

It is further possible to take an arrangement wherein the driving transmitting means has a pair of coupling gears for transmitting the rotational driving force at the boundary area between the apparatus main body and developing cartridge, the shock easing member is arranged on the driving transmitting path on the side of the developing cartridge and in the vicinity of coupling gears on the side of the developing cartridge, and thereby the rotational driving force from the apparatus main body is transmitted to the developing sleeve through the shock easing member.

It is further possible to take an arrangement wherein there are provided a plurality of projected members for transmitting rotational driving force from the apparatus main body engaged with the coupling gears on the side of the developing cartridge to the developing sleeve through the shock easing member whose thickness is established to the predetermined value depending on the rotary load to the developing cartridge.

The shock easing member mentioned above may be made of a rubber material with hardness of 40°–50° whose main component is silicon.

It is further possible to take an arrangement wherein the developing cartridge is equipped with plural developing units each having different color component and performs development stepwise for a multi-color image for each rotation of the image carrier, and the driving transmitting means is equipped with a clutch mechanism and transmits rotational driving force of the driving means to each developing unit in succession through switching thereof.

Accordingly, in the developing apparatus of an image forming apparatus related to the invention, a change in apparatus structure is not made, and cost increase due to additional parts needed for the change is not caused accordingly, and a shock caused in the course of transmission of rotational driving force is deterred, resulting in prevention of image quality deterioration caused by pitch unevenness in the sub-scanning direction in the exposure step, because a shock easing means increases gradually rotational driving force from the low speed to the predetermined speed when a driving transmitting means transmits the rotational driving force of a driving means provided independently from a driving means for an image carrier to the developing cartridge, and thereby eases a shock caused at the start of transmitting rotational driving force to the developing cartridge.

In this case, in the arrangement wherein the shock easing means controls the driving means so that rotational driving force of the developing sleeve may reach the prescribed speed at the timing on which a leading portion for recording on the image carrier arrives at the developing position of the developing cartridge, recording is started when the rotation of the developing sleeve arrives at its prescribed speed, and it is possible to develop under the optimum density and to obtain excellent image quality accordingly.

In the arrangement wherein the driving means is represented by an AC developing motor, and the shock easing means controls the AC developing motor to be turned on or off corresponding to switching of a clutch mechanism, the rotational driving force is increased gradually from the low speed to the prescribed speed and a shock caused at the start of transmitting rotational driving force to the developing cartridge can be eased accordingly.

In the arrangement wherein the driving means is represented by an DC developing motor, and the shock easing means controls the DC developing motor in terms of its speed corresponding to switching of a clutch mechanism, the rotational driving force is increased gradually from the suspension or from the low speed to the prescribed speed and a shock caused at the start of transmitting rotational driving force to the developing cartridge can be eased accordingly.

Further, in the developing apparatus of an image forming apparatus related to other example of the invention, design change can be minimized to inhibit cost increase, and transmission variation such as a shock and vibration caused in the course of transmission of rotational driving force can be inhibited so that image quality deterioration caused by uneven pitch in the sub-scanning direction in the exposure step can be prevented, because a shock easing member that eases variation of rotational driving force is provided to be located on the path for transmitting rotational driving force from a driving means and to be at the downstream side of the source for generating transmission variation.

In another example of the invention, when rotational driving force of a driving means provided independently from a driving means for an image carrier is transmitted to a developing cartridge, a shock easing means increases gradually the rotational driving force from the low speed to the prescribed speed so that a shock caused at the start of transmitting rotational driving force to the developing cartridge is eased, and further, a shock easing member inhibits vibration in the course of rotational driving force. Therefore, transmission variation such as a shock and vibration in the total period of rotational driving force can be inhibited, resulting in prevention of image quality deterioration caused by pitch unevenness in the sub-scanning direction in the exposure step.

In the example wherein the shock easing member is arranged in the vicinity of coupling gears which are provided on the driving transmitting means, variation of transmission not only to a developing sleeve but also to other driven factors in a developing cartridge can be inhibited for the greater effect of inhibition.

Further, by setting the thickness of the shock easing member depending on the degree of rotational load for the developing cartridge, optimization design can be made easily, and it is possible to simplify the structure of the driving transmitting system through the shock easing member and to achieve easy assembling in the case that a plurality of projected portions are caused to engage with coupling gears on the side of the developing cartridge and thereby the rotational driving force is transmitted to the developing sleeve.

Further, by causing the shock easing member to be made of rubber material whose hardness is 40°–50° and whose main component is silicon, it is possible to inhibit the transmission variation such as a shock and vibration to the utmost. The hardness of a rubber material in this case means one obtained through Type A Measurement described in Item 5 of JIS (Japanese Industrial Standard) Handbook K 6301-1975.

In the occasion where the shock easing member is applied to the developing apparatus performing multi-color development by switching developing units each being for different color by means of a clutch mechanism, greater effect of inhibiting transmission variation can be achieved, in particular, because a member inhibiting rotation unevenness caused by transmission variation of a photoreceptor drum such as a cleaning blade is retracted in the course of multi-color development.

DETAILED DESCRIPTION OF THE INVENTION

An example of an image forming apparatus on which the invention is applied will be explained concretely as follows, referring to FIGS. 1–3.

Figure 1:
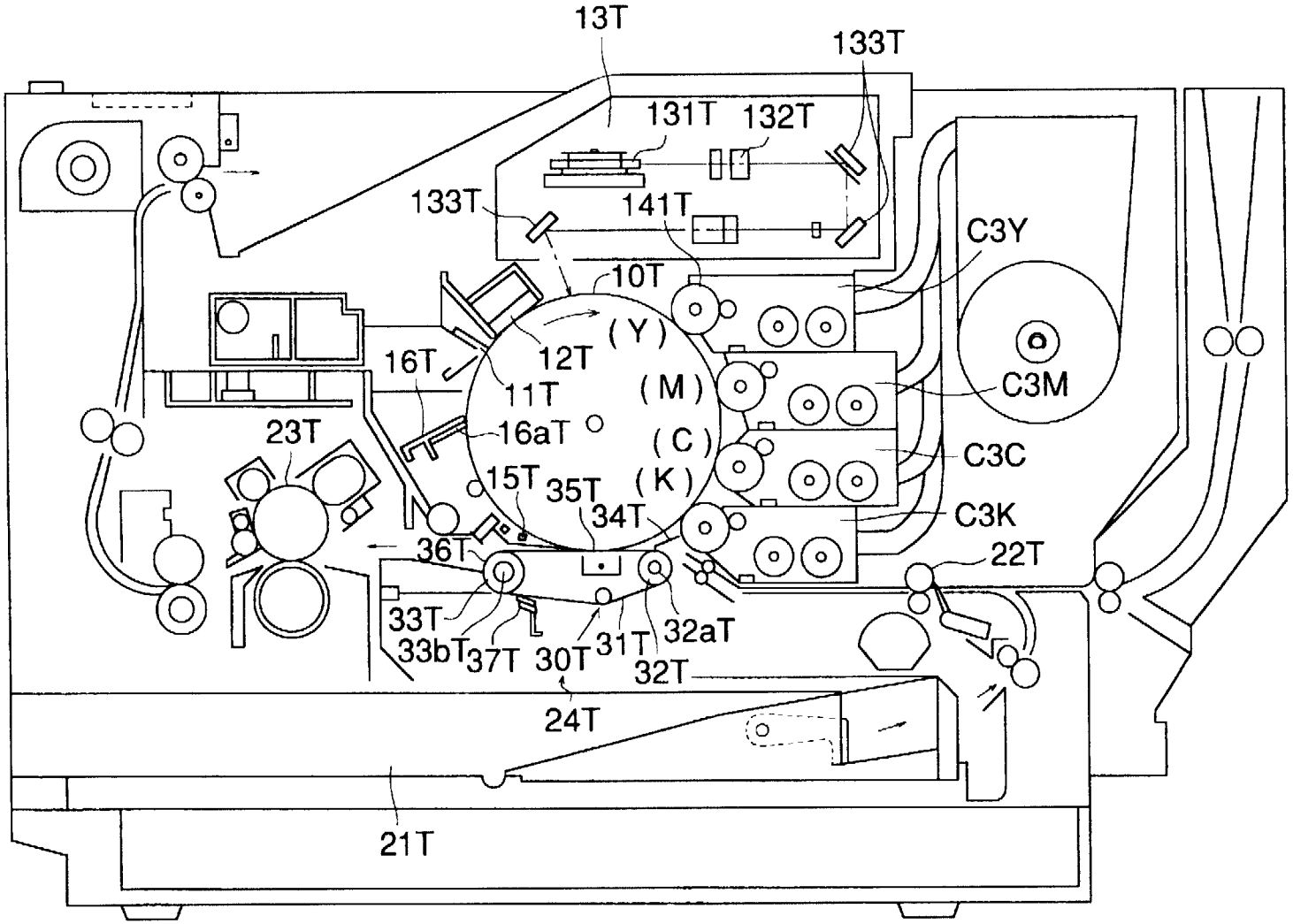
FIG. 1 is a schematic structural diagram showing the total LBP apparatus in the present example.

FIG. 1 is a schematic structural diagram showing the total LBP (Laser Beam Printer) apparatus. Photoreceptor drum 10T serving as an image carrier whose surface is coated with an OPC light-sensitive layer is rotated in the arrowed direction to be neutralized by neutralizing unit 11T so that electric charges for the preceding recording are removed, and then its circumferential surface is charged uniformly by charging unit 12T to be prepared for the succeeding recording. After this uniform charging, a laser beam based on image signals is emitted from an unillustrated laser light source in exposure unit 13T, and it is subjected to rotary scanning conducted by rotary polygon mirror 131T, and it passes through fθ lens 13T and reflection mirror 133T to be projected on the circumferential surface of the photoreceptor drum 10T in the primary-scanning direction. Thus, a latent image is formed.

Under the photoreceptor drum 10T, there is provided developing cartridge 42 for multi-color development which is capable of being attached on and detached from the apparatus main body, and the developing cartridge houses developing units C3Y, C3M, C3C and C3K in each of which there is filled a developing agent in which magnetic carrier and each toner of different color among yellow (Y), magenta (M), cyan (C) and black (Bk) are mixed.

First, developing work for the component of Y color which is the first color is done by developing sleeve 141T having therein magnets. The developing agent mentioned above is placed on the developing sleeve 141T to be a layer whose thickness is regulated to be a prescribed thickness by an unillustrated layer-forming bar, and is conveyed to the developing area. Between the photoreceptor drum 10T and the developing sleeve 141T, superposed AC bias voltage and DC bias voltage are impressed so that visualization is conducted through a known method.

After completion of development for the first color conducted in the aforesaid method, the photoreceptor drum 10T is charged uniformly again for development for the second color (M color component) without conducting transfer step, cleaning step and neutralizing step, and visualization is performed by development. For the third color (C color component) and the fourth color (Bk component) too, image forming steps identical to that for the second color are conducted, and developments for 4 colors in total are formed on the photoreceptor drum 10T finally.

On the other hand, recording sheets are drawn out from paper cassette 21T one by one by sheet-feeding mechanism 22T and fed to nip portion 35T formed between the photoreceptor drum 10T and transfer belt 31T by transfer step portion 24T around which transfer belt 31T is wound, and a multi-color image on the circumferential surface of the photoreceptor drum 10T is transferred collectively onto the recording sheet. In this case, high voltage is impressed on rotary shaft 32*a*T at upstream side 32T of the transfer belt 31T, and an electrically conductive brush is provided at the position symmetrical to the rotary shaft 32*a*T about the transfer belt 31T. Thus, the fed recording sheet enters a transfer area while being attracted to the transfer belt 31T by electric charges given to the recording sheet. The recording sheet which has been separated from the photoreceptor drum 10T is separated from the transfer belt 31T while being neutralized with an oppositely charged electrode represented by rotary shaft 33*b*T of holding roller 33T at the downstream side around which the transfer belt 31T is wound. Residual toner sticking to the transfer belt 31T is removed by cleaning blade 37T. Incidentally, the transfer belt 31T is separated from the photoreceptor drum 10T with the rotary shaft 33*b*T of the holding roller 33T positioned at the downstream side in the course of forming a multi-color image serving as a swiveling center.

The recording sheet separated from transfer step section 24T is conveyed to fixing step section 23T composed of two pressure rollers at least one of which is provided therein with a heater, where the transferred toner on the recording sheet is heat-pressed between the pressure rollers to be melted and fixed on the recording sheet which is then ejected out of the apparatus.

Residual toner sticking to the photoreceptor drum 10T after transferring is neutralized by neutralizing step section 15T, and then is conveyed to cleaning step section 16T where the residual toner is scraped off into the cleaning step section 16T by cleaning blade 16*a*T that is in contact with the photoreceptor drum 10T to be ejected by an unillustrated screw and is collected in a toner collection box. The photoreceptor drum 10T from which the residual toner is removed by the cleaning step section 16T is neutralized by neutralizing lamp 11T, and then is charged electrically uniformly by charging step section 12T to be ready for the succeeding image forming cycle. Incidentally, the cleaning blade 16*a*T is also separated from the photoreceptor drum 10T in the course of multi-color image forming, which is the same as in the case of the transfer belt 31T.

Developing cartridge C3 is one wherein developing units C3Y, C3M, C3C and C3K are supported movably in a case, and when a projection on the case is engaged with a guide on the apparatus main body for installation of the developing cartridge on the apparatus main body, the developing units C3Y, C3M, C3C and C3K are positioned. In the case of maintenance, when the developing cartridge C3 is taken out of the apparatus main body by releasing the engagement, maintenance work can be conducted easily. At both ends of each of the developing units C3Y, C3M, C3C and C3K, there are provided unillustrated stopper rolls having an outside diameter greater than that of the developing sleeve 141T, and at the rear side of each of the developing units C3Y, C3M, C3C and C3K, there is arranged an unillustrated leaf spring. When elastic force of the leaf spring urges each of the developing units C3Y, C3M, C3C and C3K against the photoreceptor drum 10T, the stopper roll comes in contact with the photoreceptor drum 10T to regulate the gap in which an appropriate amount of charging toner can move from a magnetic brush formed on the developing sleeve 141T to the surface of a latent image on the photoreceptor drum 10T in the electric field between the photoreceptor drum 10T and the developing sleeve 141T.

Figure 2:
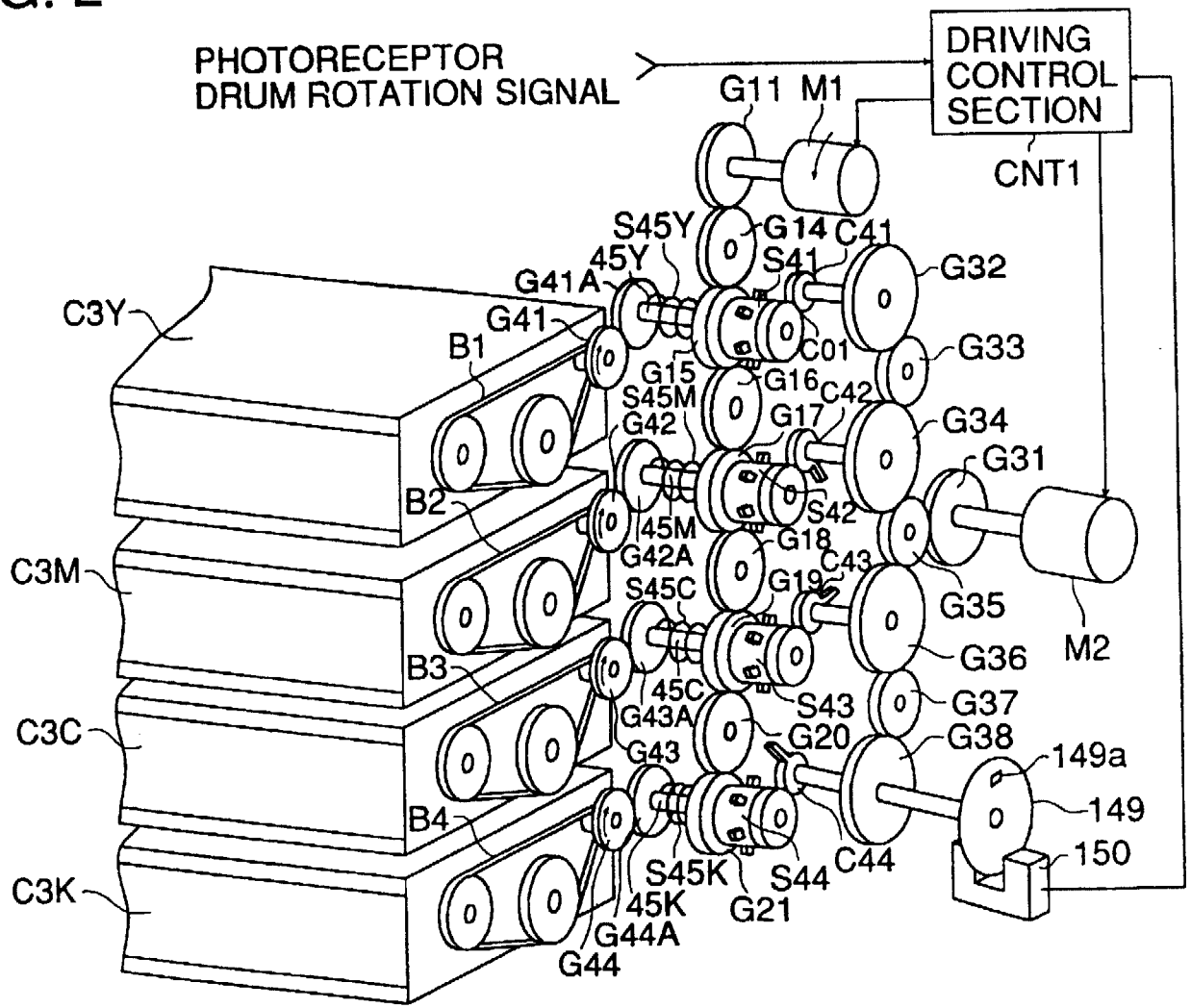
FIG. 2 is a perspective view showing the driving systems for a developing cartridge and an LBP main body in the present example.

FIG. 2 is a perspective view showing a driving system for the developing cartridge and LBP main body. Incidentally, in the drawing, only a part of the teeth is shown instead of those on the entire circumference. When the developing cartridge 3T is mounted on the apparatus main body, gears G41, G42, G43 and G44 serving as a coupling gear on the side of the developing cartridge engage with gears G41A, G42A, G43A and G44A serving as a coupling gear on the side of the apparatus main body to form a pair of coupling gears. The developing units C3Y, C3M, C3C and C3K are structured in a way that when gears G41, G42, G43 and G44 provided on the developing units are rotated, the rotation of each of them is transmitted by each of transmission belts B1, B2, B3 and B4, and developing sleeve 141T and a stirring screw of each developing unit are rotated so that the developing unit can function.

M1 is a motor for driving a developing unit as a driving means, and it is provided independently of a motor for driving a photoreceptor drum so that it can drive developing units C3Y, C3M, C3C and C3K. On the other hand, M2 is a motor for driving a cam, and it switches driving of the developing units C3Y, C3M, C3C and C3K. An AC motor is used for the motor M1 usually from the viewpoint of cost, and a pulse motor is used for the motor M2 from the viewpoint of easy control.

First, a gear train for development driving rotated by the motor M1 will be explained. Gear 11 on the motor M1 is engaged in series with gears G14, G15, G16, G17, G18, G19, G20 and G21. Among them, G14, G16, G18 and G20 are idle gears which are provided so that the developing units C3Y, C3M, C3C and C3K are driven in the same direction.

There is provided gear G41A on a coaxial basis with gear G15, and between the gear G15 and gear G41A, there is provided spring clutch S41 which is for switching between engagement and disengagement of gears. This relation applies also for spring clutch S42 for gear G17 and G42*a*, spring clutch S43 for gear G19 and G43*a*, and spring clutch S44 for gear G21 and G44*a*. Gears G41A, G42A, G43A and G44A and gears G41, G42, G43 and G44 are arranged so that their tapered portions are opposite to each other, and shafts 45Y, 45M, 45C and 45K have play in their rotational direction so that gears A41, G42, G43 and G44 can rotate slightly even in the case of no transmission of rotation. Accordingly, the gears can engage smoothly even when their teeth are in phase of interference on the occasion of movement of gears G41A, G42A, G43A and G44A in the axial direction.

In FIG. 2, when the developing unit C3Y is in the state of being capable for developing, gear G41A engages with gear G41, and this relation applies also to developing units C3M, C3C and C3K and gears G42A, G43A and G44A engage with gears G42, G43 and G44. When viewing cam driving, gears G32, G33, G34, G35, G36, G37 and G38 engage in series, and gear G35 among them engages with G31 mounted on the rotary shaft of motor M2 so that driven rotation can be transmitted.

Cam C41 is provided on gear G32 on a coaxial basis. The cam 41 is one that switches to engagement against spring clutch S41. Gear G34 and cam C42, gear G36 and cam C43 and gear G38 and cam C44 are on the coaxial relation respectively, and switching for engagement for each of them is conducted against each of spring clutches S42, S43 and S44.

With regard to the relation in terms of phase for cams C41, C42, C43 and C44, each of them is provided in a way that an angular shift of 90° is given to each cam. Namely, each is divided equally into 4 portions, and each projected portion CO1 is positioned in each of 4 directions.

In the driving system of the LBP main body having the arrangement mentioned above, even when motor M1 is turned on, each of developing units C3Y, C3M, C3C and C3K does not operate in the course of image forming, because spring clutches S41–S44 do not transmit rotation as they are. In the case of development, drive control section CNT1 which will be explained later drives motor M2 to rotate the cam clockwise by 45°, and stops it at its position. Thereby, the cam C41 comes in contact with spring clutch S41. So the clutch S41 connects the driving transmission of motor M1, and rotation drive to developing unit C3Y is transmitted. Then, when the cam is rotated further by 90° and is stopped at its position, driving transmission to the developing unit C3Y is stopped, and cam C42 comes in contact with spring clutch S42 in turn, and rotation drive is transmitted to developing unit C3M. This applies similarly to the succeeding case wherein when the cam is further rotated by 90° clockwise and is stopped at its position, cam C43 comes in contact with spring clutch S43, and developing unit C3C in place of C3M operates. When the cam is rotated further by 90° clockwise and is stopped at its position, switching to drive transmission to developing unit C3K is made. Due to rotation drive transmitted by a gear train connected to motor M2 that is provided on the apparatus main body and to switching operation made by a spring clutch, rotation drive of motor M1 transmitted by a gear train connected to motor M1 is transmitted to each of developing units C3Y, C3M, C3C and C3K for a certain period of time at desired timing. Incidentally, a rotation drive transmitting system covering from motor M1 to developing sleeve 141T of developing cartridge 3T has a function as a drive transmitting means.

There is provided rotary plate 149 having thereon opening 149*a* on a coaxial basis with gear G38 each time the opening on the rotary plate crosses photo-coupler 150 arranged under the rotary plate, the photo-copier generates rotation signals of gear G38 and outputs them to drive controlling section CNT1.

The drive controlling section CNT1 drives motor M1 and motor M2 provided on LBP apparatus and thereby controls rotation drive for developing units C3Y, C3M, C3C and C3K, and for that purpose, CPU that operates based on input information for driving use in accordance with a control program prepared in ROM in advance is used.

The drive control includes the control to rotate or stops motor M1 for driving a developing unit and the control to rotate or stops motor M2 for switching the drive for developing units C3Y, C3M, C3C and C3K, and a power source driver for motor M1 is controlled so that appropriate development can be done from the leading edge of recording exposed on a photoreceptor drum by inputting photoreceptor drum rotation signals from the outside and by calculating an amount of rotation of the photoreceptor drum 10T, and also the motor M2 is controlled so that drive transmission for the developing units C3Y, C3M, C3C and C3K can be switched by inputting rotation signals of the aforesaid gear G38 and by controlling rotation of cams C41–C44 while recognizing the rotation position of the cam.

Figure 3:
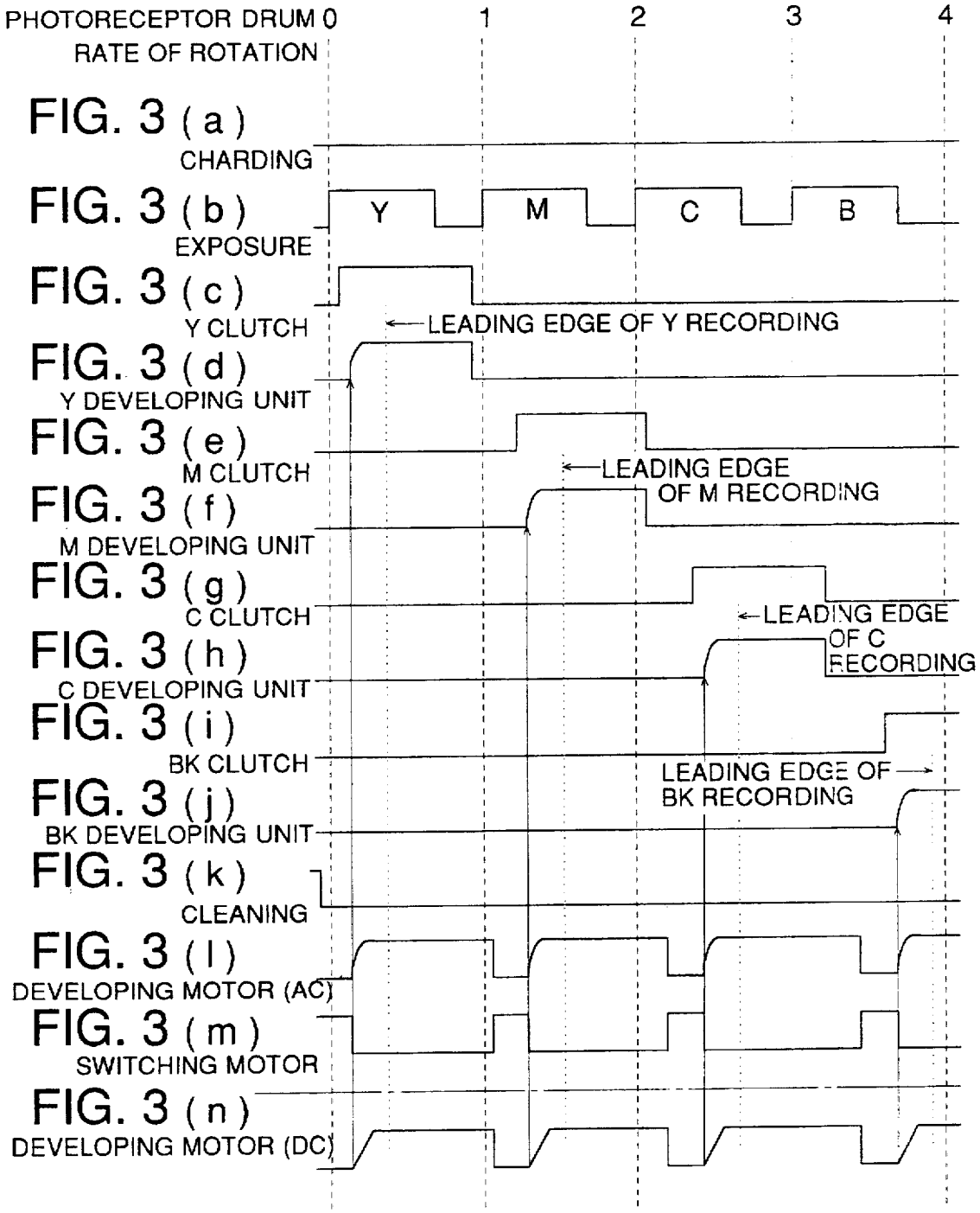
FIGS. 3 (*a*)–3 (*n*) represent timing chart diagrams of multi-color development in the present example.

FIG. 3 shows timing charts for multi-color development, and control of drive transmitting system will be explained in detail as follows, referring to the drawing.

The abscissa shows the passage of time representing the number of rotations of photoreceptor drum 10T. The ordinate shows each section of the apparatus. Incidentally, as shown by item (k) cleaning, it is assumed that cleaning is finished before the start point showing 0 in terms of the number of rotations of a photoreceptor drum.

First, drive controlling section CNT1 turns off the power source for motor M1 and conducts initial operation for spring clutches S41–S44 to cut a drive transmitting path through motor M2. Simultaneously with the start of rotation of photoreceptor drum 10T, charging step section 12T starts charging as shown with "charging" in FIG. 3 (*a*), and exposure unit 13T irradiates photoreceptor drum 10T with a laser beam of Y color component based on image signals as shown with "exposure" in FIG. 3 (*b*). In this case, an unillustrated main control section of the apparatus main body outputs photoreceptor drum rotation signals to the drive controlling section CNT1 in synchronization with exposure operation to tell the position of the leading edge of recording.

After that, motor M2 is rotated as shown with "switching motor" in FIG. 3 (*m*) and spring clutch S41 is operated as shown with "Y clutch" in FIG. 3 (*c*) to connect the drive transmitting path to developing unit C3Y, and immediately after that, the power source for motor M1 is turned on as shown with "developing motor" in FIG. 3 (*l*) so that rotation drive may be started. At this point, motor M2 is stopped. Rotation drive is transmitted as it is to developing cartridge 3T through a pair of coupling gears G41A and G41, and developing sleeve C3Y starts rotating as shown with "developing unit" in FIG. 3 (*d*). In this case, response is low because an AC motor used as motor M1 as stated above, and the speed of rotation is increased gradually from a low speed to a prescribed speed accordingly. As a result, compared with a conventional way wherein rotation of motor M1 that is rotating at its fixed speed is transmitted to a developing sleeve abruptly, shock generated at the start of transmitting rotation drive can be eased. Thus, the leading edge of recording on photoreceptor drum 10T reaches the developing position so that development for Y color component is conducted when motor M1, in other words, developing sleeve C3Y has risen up to its displacements speed of rotation.

Since the control is made so that the drive transmission to the developing cartridge 3T is increased gradually, unevenness in rotation of photoreceptor drum 10T is inhibited sufficiently, and it is possible to prevent image deterioration caused by pitch unevenness in the sub-scanning direction in the exposure step. In addition, it is possible to cope with this control by means of a control program without requiring large-scale design change for the apparatus main body. Therefore, it is possible to inhibit cost increase. In this case, a series of control for increasing gradually the speed of rotation of motor M1 to be transmitted to a developing sleeve has a function as a shock easing means.

On the other hand, after photoreceptor drum rotation signals generated from a main control section are inputted, the drive controlling section CNT1 calculates, based on a control program, the time when the leading edge of recording on photoreceptor drum 10T arrives at the developing position, and the time when developing sleeve C3Y of developing unit C3Y (Y color component) rises up to its stationary speed, and it controls driving of motor M1 so that these arriving time and rising time may coincide. In the present example, therefore, when the leading edge of recording arrives at the developing position, developing sleeve C3Y is rotating at its prescribed speed after completion of its transitional state in terms of speed of rotation, resulting in development with appropriate density and excellent image quality obtained, though developed density is usually affected by speed of rotation of a developing sleeve. Incidentally, the timing has been adjusted so that the leading edge of recording can be developed after the elapsed time slightly longer than the rising time of motor M1. The reason for the above is to control motor M1 in consideration of backlash between plural gears constituting rotation drive transmitting system covering from motor M1 to developing sleeve 141T of developing cartridge 3T and of positional displacements for the start of exposure and the start of envelopment caused by tolerance of component parts.

After completion of development for Y color component, the drive controlling section CNT1 controls motor M2 to cut spring clutch S41 so that the rotation of developing sleeve C3Y is stopped, and turns off the power source for motor M1.

When the number of rotations of a photoreceptor drum arrives at 1 and exposure for Y color component is started, the drive controlling section CNT1 stops the drive transmitting to developing unit C3Y by controlling rotation and stop of motor M2 and transmits rotation drive to developing unit C3M in turn, because the rotational position of a cam is recognized by the drive controlling section CNT1 due to rotation signals from photo-coupler 150. For M color component, C color component and Bk color component, the same development control is conducted for visualizing images.

In the present example, a spring clutch is connected after turning off motor M1, and then the motor M1 is turned on. However, it is possible to make a slight design change wherein a spring clutch is connected while motor M1 is running at a low speed under which a shock generated at the start of transmitting rotation drive is not problematic in practical use. In this case, it is possible to make a developing sleeve to rise quickly, which is suitable for high speed development.

Further, a DC motor, for example, can also be used for motor M1 though an AC motor is used for it in the present example, which means that the kind of a motor is not limited. If the drive controlling section CNT1 conducts speed control such as known PLL control as shown with "developing motor" in FIG. 3 (*n*) so that an appropriate gradient of speed change capable of easing a shock to an exposure step can be obtained, it is possible to establish various variations for increasing the speed of rotation gradually from zero or a low speed to a prescribed speed, and thereby to shorten the rising time likewise.

In addition, though a CPU is used for the drive controlling section CNT1 for the operation by means of a control program in the present example, the time to arrive the developing position and the rising time of a developing sleeve vary from an apparatus to an apparatus. Therefore, if each apparatus is optimized on the occasion of factory shipment by establishing a table for timing adjustment on a control program, it is possible to reduce margin for correcting dispersion, or to conduct the same drive control with a gate-arrayed hard circuit in place of an exclusive CPU. In this case, it is possible to realize further advancement for higher speed operation.

Another example will be explained concretely next, referring to FIGS. 4–11.

Figure 4:
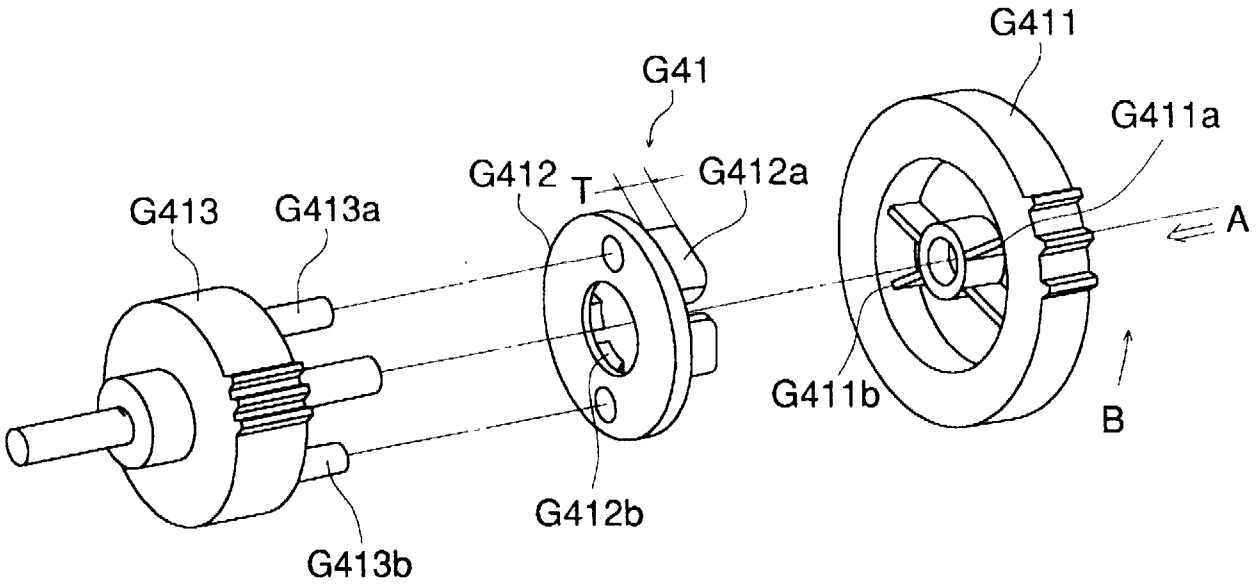
FIG. 4 is a detailed exploded diagram of coupling gears on the side of a developing cartridge in another example.

FIG. 4 is a detailed exploded view of gear G41 serving as a coupling gear of developing cartridge 3T shown in FIG. 2. Incidentally, in the drawing, only gear G41 used for developing unit C3Y for Y color component is shown, but the same constitution is applied also to gears G42, G43 and G44 used respectively for developing units C3M, C3C and C3K for M color component, C color component and Bk color component, respectively. Therefore, developing unit C3Y for Y color component only will be explained as follows. With regard to teeth of a gear, only a part of them is shown on the drawing instead of those on the entire circumference.

After irradiation with a laser beam by means of exposure unit 13T, spring clutch S41 operates at the timing with which the leading edge of recording reaches the developing position, and thereby rotation drive of motor M1 is transmitted to gear G411 serving as a coupling gear of developing cartridge 3T through gear G41A serving as a coupling gear located on the apparatus main body, and finally, the rotation drive is transmitted by transmitting belt B1 engaged with gear G413 to each component part such as developing sleeve 141T and a stirring screw so that the developing unit C3Y may function. In this case, the rotation drive transmission control for motor M1 is of a type to connect the rotation drive under the condition of the rotation at a stationary speed even when it is a type of clutch connection used commonly with a drive source for photoreceptor drum 10T or a motor provided independently of the photoreceptor drum 10T.

With regard to gear G41, gear G411 and gear G413 therein used to be constituted to be an integrally-molded one made simply of resin in the past. In the present example, however, the gear is characterized by the constitution wherein rotation drive is transmitted from gear G411 to gear G413 through silicone rubber member G412.

Figure 5:
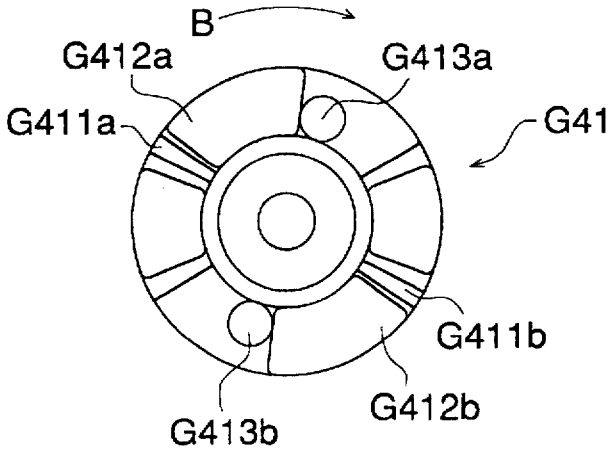
FIG. 5 is a diagram illustrating coupling gears assembled in another example.

FIG. 5 is a diagram wherein assembled gear G41 shown in FIG. 4 is viewed in the arrowed direction, and its constitution and operation will be explained in detail as follows, referring to FIGS. 4–5. First, on the internal circumferential surface of gear G411 made of resin, there are provided a rotary shaft hole and 4 wall-like portions, and wall-like portions which transmit rotation drive directly are given symbols G411*a* and G411*b* respectively. Elastic member G412 is a member that is integrally-molded with silicone rubber whose main component is silicon, and it has 4 projected portions each having a thickness of T, among which the ones coming into direct contact with the wall-like portions G411*a* and G411*b* are given symbols G412*a* and G412*b* respectively. It further has engagement holes adjoining the projected portions G412*a* and G412*b* respectively. Gear G413 made of resin is engaged with a metallic shaft, and metallic projected members G413*a* and G413*b* are embedded on its circumference.

When assembling the gear G41, a rotary shaft of gear G413 is to be engaged with the rotary shaft hole of the gear G411 through the elastic member G412, and projected members G413*a* and G413*b* are caused to pass through engagement holes of the elastic member G412 respectively. Thereby, the projected members G413*a* and G413*b* are brought into contact with the projected portions G412*a* and G412*b* respectively for engagement. In this case, a length of each of projected members G413*a* and G413*b* is established so that the length may come in contact with an entire area in the thickness of each of the projected portions G412*a* and G412*b* for the purpose of transmitting the rotation drive stably from the elastic projected portions G412*a* and G412*b*.

Since the projected portions G412*a* and G412*b* of the elastic member G412 are engaged with an internal surface of the gear G411 while they keep being engaged with the projected members G413*a* and G413*b*, the appearance remains unchanged from the conventional gear G41, preventing a large size caused by additional component parts.

In the arrangement mentioned above, when rotation drive in the arrowed direction is transmitted, if the wall-like portions G411*a* and G411*b* of the gear G411 come in contact respectively with the projected portions G412*a* and G412*b* of the elastic member G412, the elastic member G412, especially projected portions G412*a* and G412*b* serving as a shock easing member transmit the rotation drive to the projected members G413*a* and G413*b* while absorbing transmission variations such as a shock at the start of transmitting rotation drive and unnecessary stationary vibration in the course of drive transmission. Thus, the gear G413 is rotated by this projected members G413*a* and G413*b*.

The stationary vibration will be explained here. The developing cartridge 3T can be freely attached on and detached from the apparatus main body for easy maintenance. When viewed from the viewpoint of drive transmission, however, it means that factors causing instability are increased. Namely, the boundary area between the apparatus main body and developing cartridge 3T lacks its rigidity, and thereby a pair of coupling gears G41A and G41 become a source of stationary vibration. As a result, vibration is transmitted stationarily to a photoreceptor drum through stopper rolls of the developing sleeve 141T, and it causes image quality deterioration caused by pitch unevenness in the sub-scanning direction just like the aforesaid shock generated at the start of drive transmission.

In the present example, it is possible to prevent pitch unevenness in the sub-scanning direction in the exposure step by providing elastic member G412 between gear G411 and gear 413 which are located on the transmission path of rotation drive for motor M1 and located at the downstream side of the paired coupling gears G41*a* and G41 representing a source for generating transmission variation. It is further possible to inhibit cost increase because neither substantial addition of parts nor additional processing or machining is required. In particular, since the elastic member G412 is provided in the vicinity of the paired coupling gears G41*a* and G41, transmission of vibration not only to developing sleeve 141T but also to other driven factors such as a stirring screw in the developing cartridge 3T and others can be inhibited. Accordingly, a vibration is not transmitted from driven factors to developing sleeve 141T, which can further enhance the inhibition effect.

Next, results of measurement of transmission variation caused on the occasion of using elastic member G412 will be described as follows.

Figure 6:
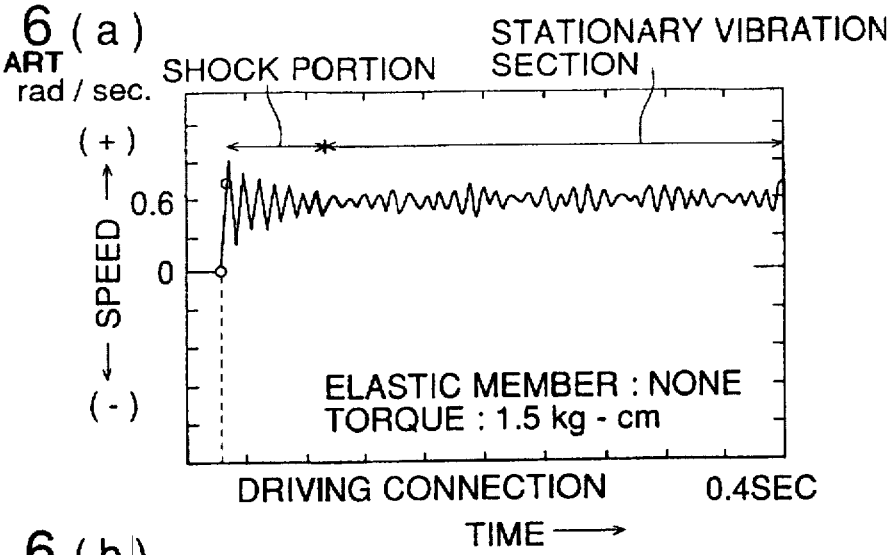
FIG. 6 (a) PRIOR ART
FIGS. 6 (*a*)–6 (*c*) represent response characteristic diagrams showing response characteristics for load variations in other examples.
Figure 6:
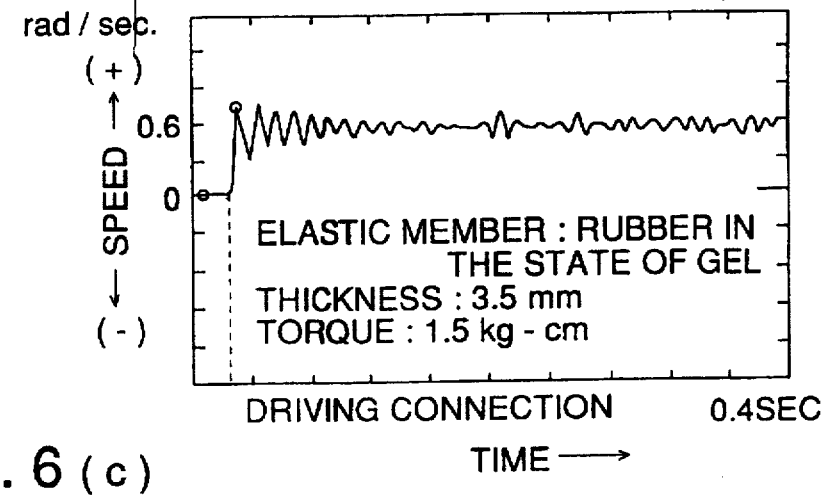
FIG. 6 (b) PRIOR ART
Figure 6:
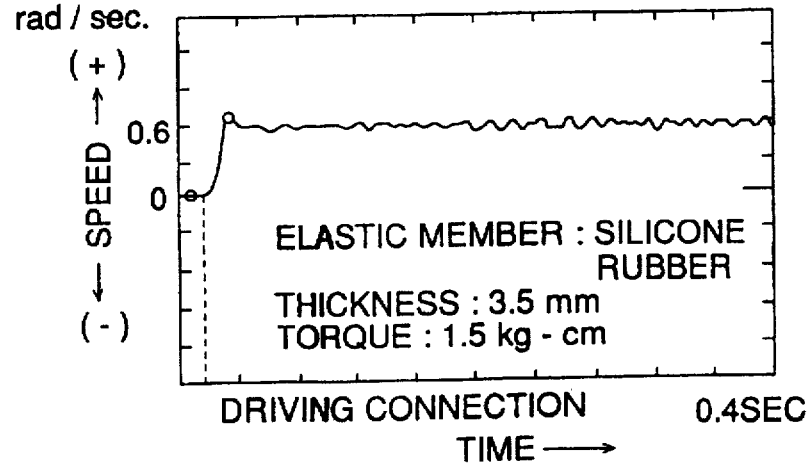
FIG. 6 (c) PRIOR ART

FIG. 6 is a response characteristic diagram showing response characteristics for load variation, in which a load requiring torque of 1.5 kg-cm is connected to coupling gear G41, and this load is equivalent to that required for rotating developing cartridge 3T in the present example. There is measured the speed of rotation based on the time elapsed from the moment when rotation drive of motor M1 running stationarily is clutch-connected. FIG. 6 (*a*) is an example of conventional one for comparison wherein the case of integrally-molded gear having no elastic member is shown, while FIG. 6 (*b*) is coupling gear G41 of the present example in which gel-like rubber (hardness of about 20°) having a thickness of 3.5 mm that is available on the market is used in particular. FIG. 6 (*c*) represents also the present example wherein silicone rubber (hardness of about 50°) having a thickness of 3.5 mm is used for the elastic member.

In the response characteristics in FIG. 6 (*a*), after the shock is measured (shock portion) from the moment of drive connection, stationary vibration continues (stationary vibration portion). On the contrary, in FIG. 6 (*b*), converging time is long although an amplitude of shock is inhibited, resulting in insufficient inhibition of stationary vibration. In FIG. 6 (*c*), on the other hand, an amplitude of shock is small and converging time is short. Further, stationary vibration is inhibited and excellent results are obtained. As stated above, compared with the conventional gear of integrally-molded type mentioned above, it has been cleared that transmission variation such as a shock and stationary vibration can be reduced in the case where an elastic member is used, and inhibition effect depends upon the hardness of the elastic member.

Figure 7:
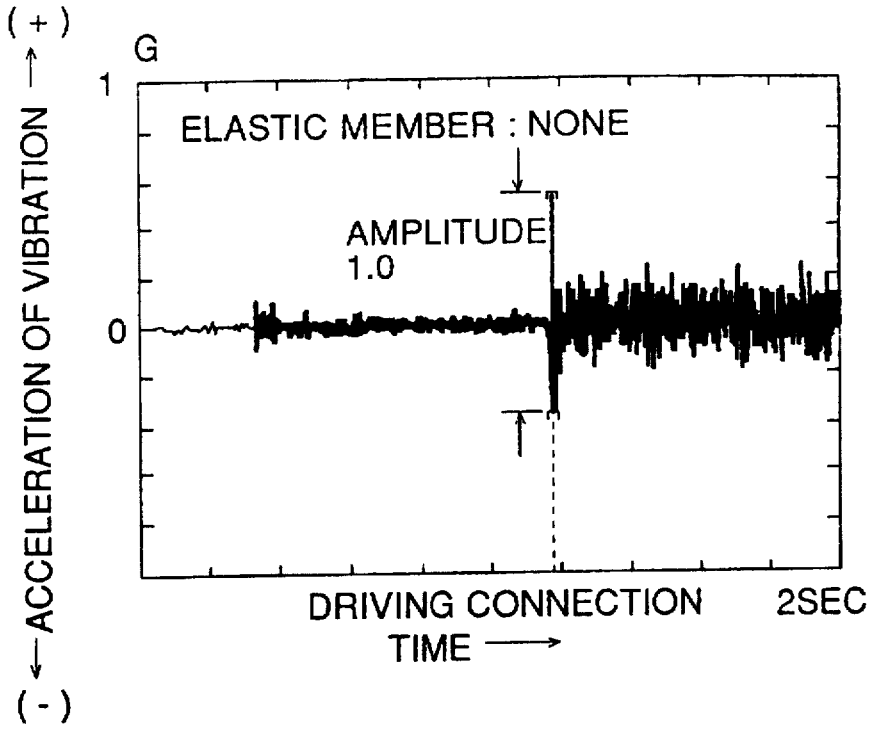
FIG. 7 (a) PRIOR ART
FIGS. 7 (*a*) and 7 (*b*) represent response characteristic diagrams showing response characteristics for load variations in other examples.
Figure 7:
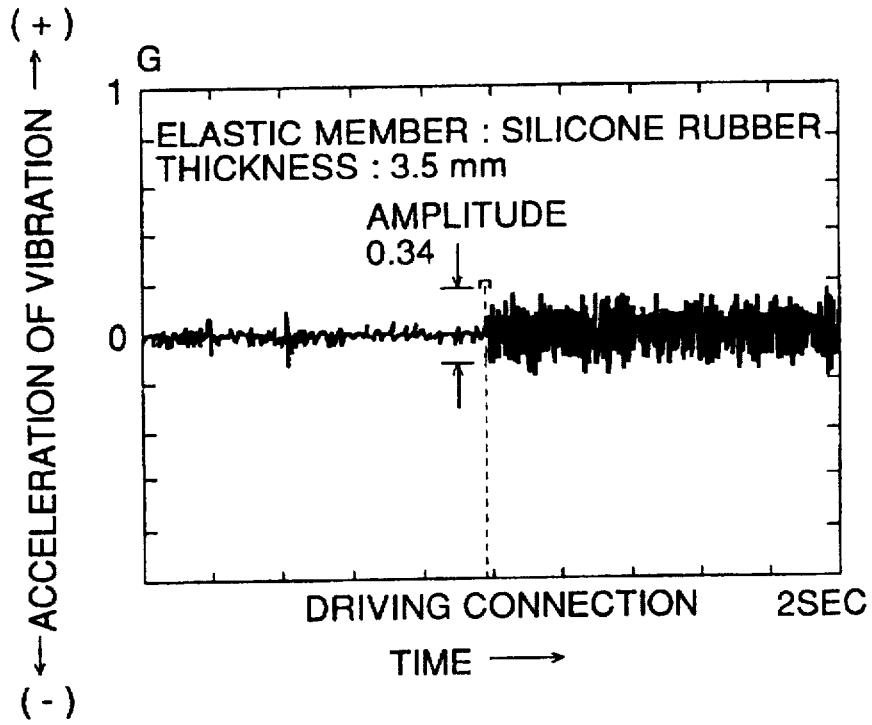
FIG. 7 (b) PRIOR ART

FIG. 7 is a response characteristic diagram showing the response characteristics for load variations, wherein vibrations of developing cartridge 3T mounted on the apparatus main body were actually measured in accordance with the elapsed time. FIG. 7 (*a*) shows an occasion of integrally-molded gear having no elastic member, while FIG. 7 (*b*) shows an occasion where silicone rubber (hardness of about 50°) having a thickness of 3.5 mm that is used for the elastic member G412. Due to this arrangement, a shock and stationary vibrations are inhibited, and in particular, an effect for inhibiting a shock at the start of transmitting rotation drive is marvelous.

Figure 8:
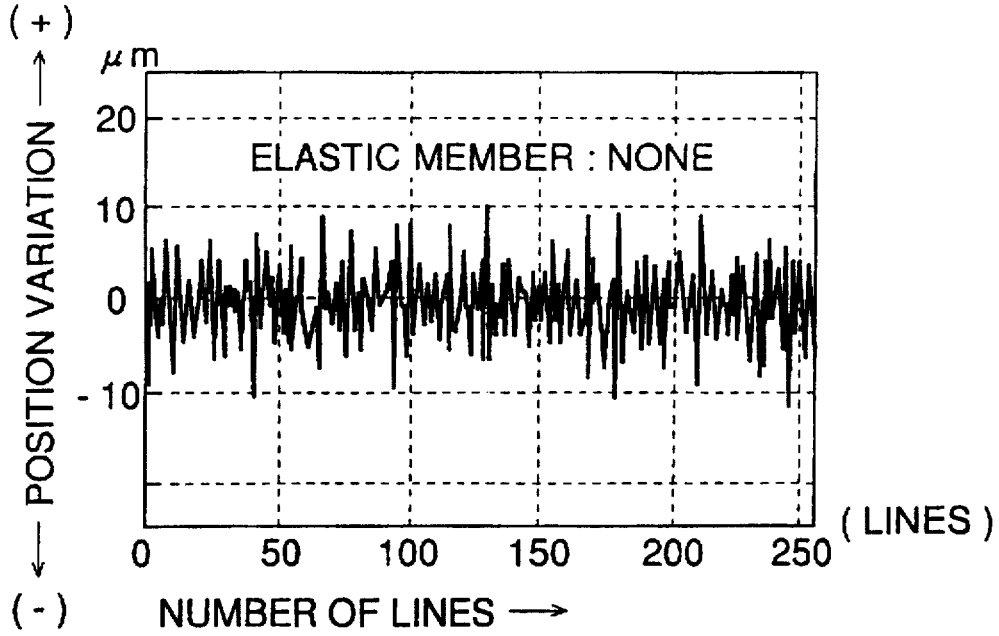
FIG. 8 (a) PRIOR ART
FIGS. 8 (*a*) and 8 (*b*) represent position variation characteristic diagrams illustrating influence of stationary vibration on position variation.
Figure 8:
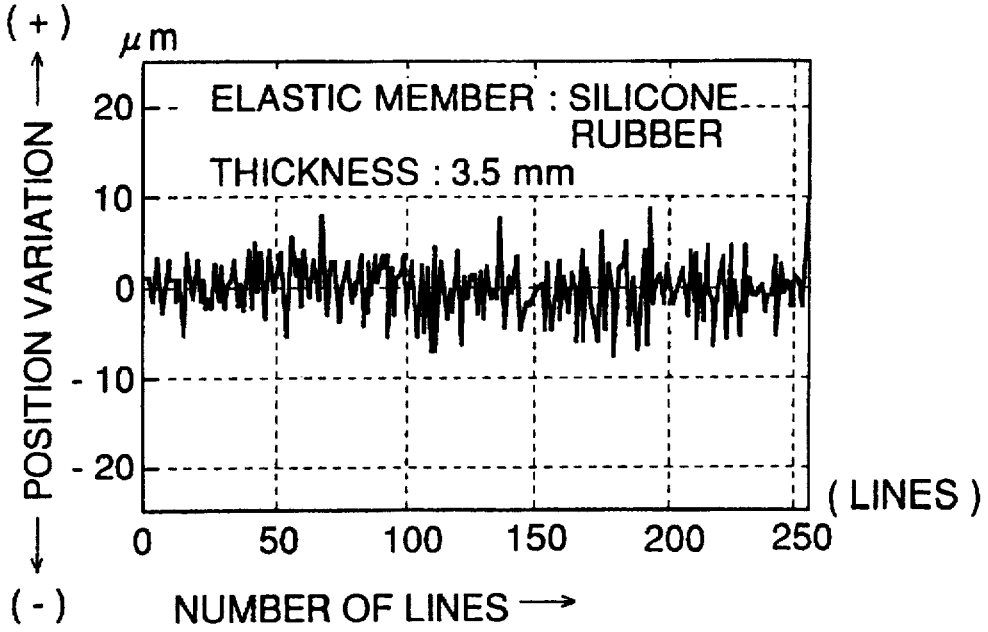
FIG. 8 (b) PRIOR ART

FIG. 8 is a diagram of position variation characteristics showing an influence of stationary vibrations on position variations wherein 256 line images are recorded at regular intervals and position variation of each line image is measured. Therefore, position variations of images tell the position variation of photoreceptor drum 10T. FIG. 8 (*a*) is a conventional example that shows an occasion of a conventional integrally-molded gear having no elastic member G412, while FIG. 8 (*b*) shows coupling gear G41 of the present example wherein silicone rubber having a thickness of 3.5 mm is used for the elastic member G412. In the case of comparison wherein P—P value of position variation is normalized to 1.0, it has been cleared that the present example having the arrangement mentioned above shows 0.79 and position variation is reduced by about 21%.

Figure 9:
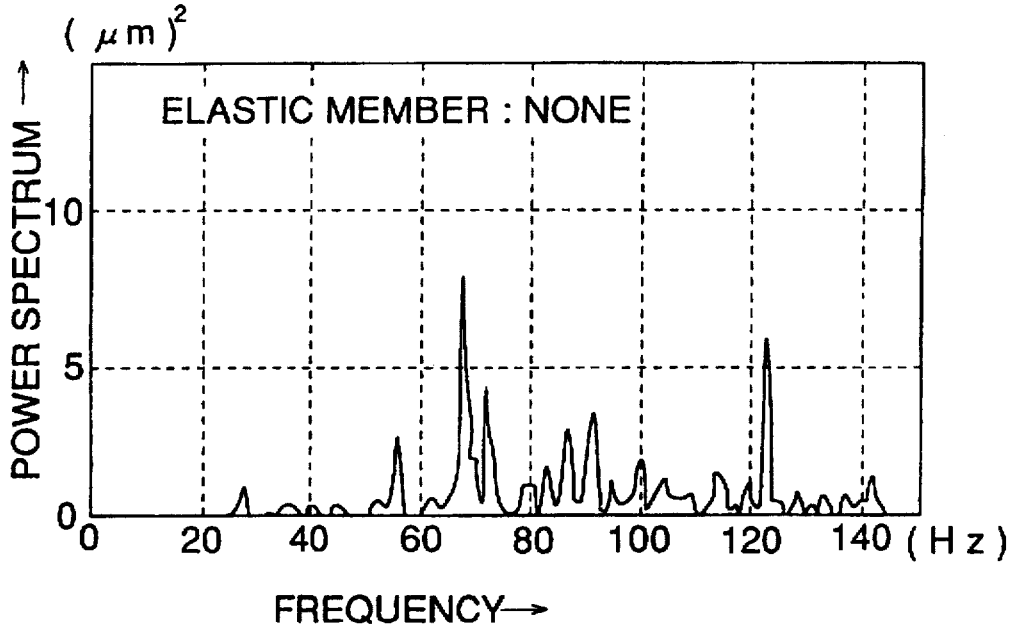
FIG. 9 (a) PRIOR ART
FIGS. 9 (*a*) and 9 (*b*) are diagrams showing power spectrum of a frequency domain in other examples.
Figure 9:
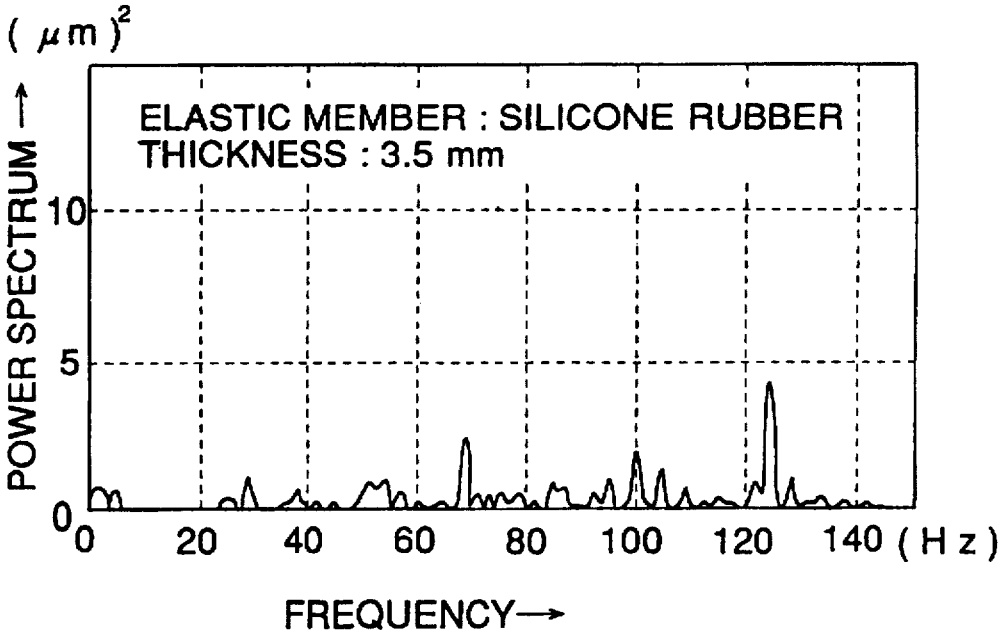
FIG. 9 (b) PRIOR ART

FIG. 9 is a diagram showing a power spectrum of a frequency domain for position variation shown in FIG. 8 wherein stationary vibrations are generated, wherein photoreceptor drum 10T was measured. FIG. 8 (*a*) is a conventional example that shows an occasion of a conventional integrally-molded gear having no elastic member G412, while FIG. 9 (*b*) shows coupling gear G41 of the present example wherein silicone rubber having a thickness of 3.5 mm is used for the elastic member G412. FIG. 9 (*a*) shows that stationary vibrations can be inhibited effectively if the vibrations generated from coupling gears G41A and G41 among the total stationary vibrations are mainly eased, because energy of 69 Hz representing a vibration frequency component of coupling gears G41A and G41 is especially high. It is understood that vibration energy not only of 69 Hz but also of total frequency band of vibration generation are inhibited as shown in FIG. 9 (*b*), when elastic member G412 is provided on coupling gear G41 based on the results mentioned above.

Therefore, in the case of plural sources for generating stationary vibrations existing, when a frequency component of stationary vibration generation source having high vibration energy is recognized, a stationary vibration generating source with high distribution energy is identified from a driving cycle of apparatus component factors, and when an elastic member capable of inhibiting vibrations of the aforesaid frequency component is selected, it is possible to inhibit stationary vibrations effectively and to reduce man-hours needed for development of a technology for inhibiting vibrations.

Figure 10:
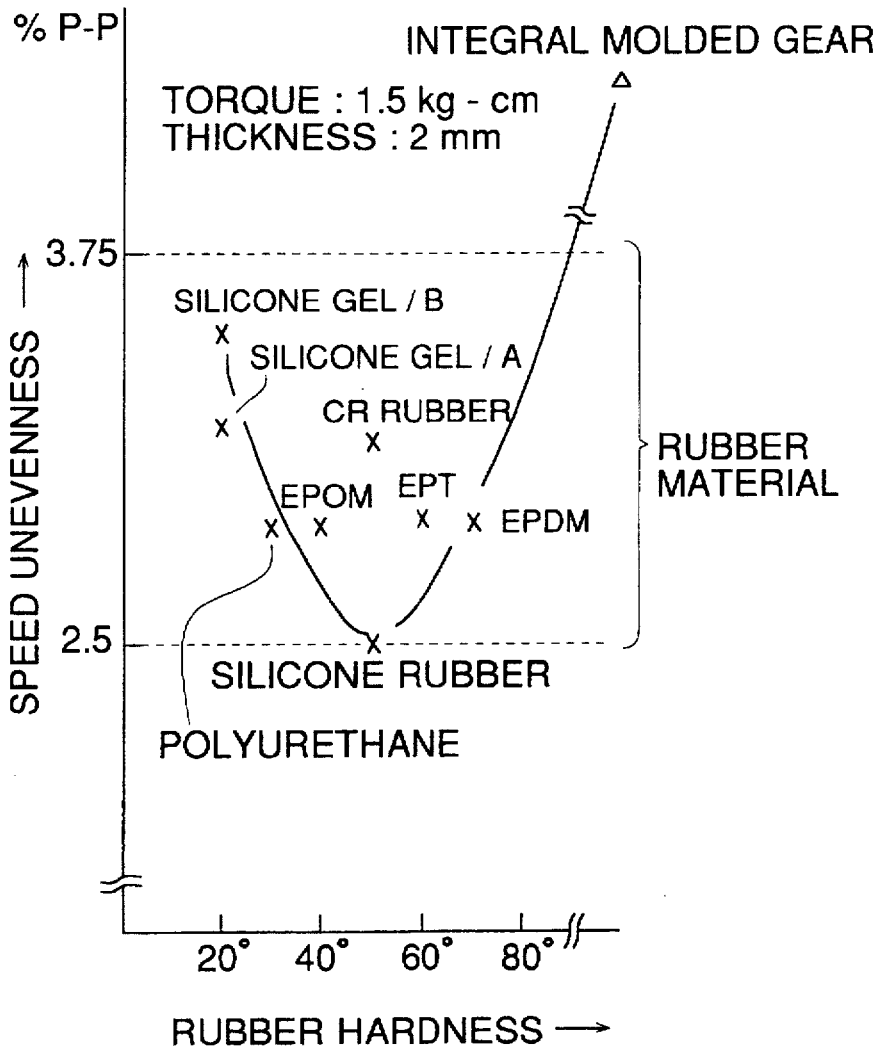
FIG. 10 is a diagram showing Fourier spectrum in a frequency domain of stationary vibration in another example.

FIG. 10 is a diagram showing speed unevenness of photoreceptor drum 10T depending on rubber hardness in the form of a relative value corresponding to the kind of an elastic member. This tells that rubber materials having rubber hardness of 20–80° (silicone gel, EPDM, CR rubber and polyurethane available on the market) have the effect of inhibiting actual shocks and stationary vibrations, as an elastic member. In particular, silicone rubber with rubber hardness of 40°–50° whose main component is silicon is preferable.

Figure 11:
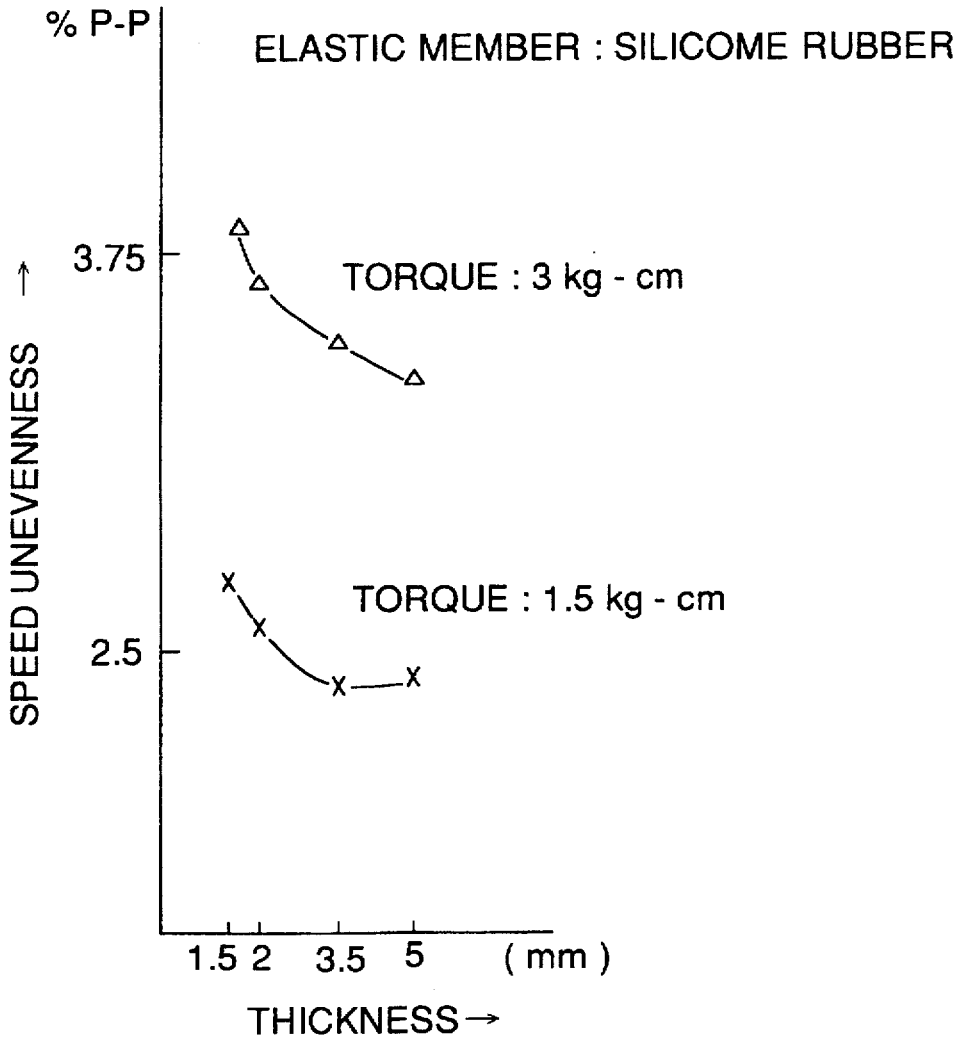
FIG. 11 is a diagram showing the relation between the thickness of silicone rubber and speed unevenness of a photoreceptor drum in other examples.

FIG. 11 is a diagram wherein speed unevenness of photoreceptor drum 10T depending on thicknesses of silicone rubber is indicated in the form of a relative value corresponding to torque. Since the load corresponding to that for driving developing cartridge 3T applied to the present example for rotation corresponds to torque of 1.5 kg-cm from the aforesaid results, when thickness (T) is made to be 3.5 mm or more, the effect for inhibiting actual shocks and stationary vibrations can be obtained, and setting the thickness within a range of 3.5–5.0 mm, in particular, is optimum for obtaining the inhibition effect without causing coupling gear G41 to be large in size.

As is apparent from FIGS. 10 and 11, transmission variation inhibiting power of an elastic member depends on a rubber hardness, and further, a thickness of an elastic member is a factor for displaying the power to the utmost. Accordingly, it is possible to achieve the optimum design for an elastic member in a short time, by selecting the material by its rubber hardness and by measuring vibration inhibition characteristics for various thicknesses based on rotational load used in an apparatus, in the case of selecting elastic members.

Owing to the constitution wherein projected members G413*a* and G413*b* applied to the present example are engaged with projected portions G412*a* and G412*b* of elastic member G412 so that they come in contact each other, it is possible to simplify the structure of a drive transmission system through elastic member G412 of the optimum design, and to achieve easy assembling.

Further, the technology to control transmission of rotation drive and the technology to provide an elastic member on the source of generating transmission variation, both for the purpose of inhibiting transmission variation have been described. Each of these technologies has its own effect independently. For example, due to the combination wherein rotation drive of motor M1 is controlled to increase after provision of motor M1 provided independently of photoreceptor drum 10T and connection of a clutch thereto, and elastic member G412 is provided on coupling gear G41, there is displayed a synergistic effect caused by the drive control and the elastic member for inhibiting transmission variation for the shock generated at the start of transmitting rotation drive, and further, the stationary vibration in the course of transmitting rotation drive can also be inhibited mainly by the elastic member. Accordingly, transmission variations such as shocks and vibrations in the total period of rotation drive can be inhibited, resulting in an ideal developing apparatus capable of preventing further image quality deterioration caused by pitch unevenness in the sub-scanning direction in the exposure step.

Owing to these technologies for inhibiting transmission variation mentioned above, it is possible to enhance the effect of inhibiting transmission variation, in particular, in multi-color development wherein a member for inhibiting rotational unevenness caused by transmission variation of photoreceptor drum 10T such as a cleaning blade is retreated temporarily in the course of operation of an apparatus.

Though an LBP apparatus has been described in the present example, the invention can be applied also to an image forming apparatus wherein rotation drive is transmitted to the same developing cartridge and thereby a latent image on a photoreceptor drum is visualized.

Though multi-color development has been described in the present example, the invention can also be applied to black and white development.

As stated above, in a developing apparatus in use with an image forming apparatus of the invention, when a drive transmitting means transmits rotation drive to a developing cartridge, a shock easing means increases gradually the rotation drive from a low speed to a prescribed speed and thereby eases a shock generated at the start of transmission of the rotation drive. Therefore, no change in apparatus structure is required, resulting in no cost increase caused by addition of parts, and shocks in the course of transmission of rotation drive are inhibited, resulting in prevention of image quality deterioration.

In this case, when the timing for a leading edge of recording to arrive at the developing position is synchronized with that for a developing sleeve to reach its stationary speed, it is possible to develop with appropriate density and to obtain excellent image quality.

Further, in the case where a driving means is an AC developing motor and a shock easing means controls to turn the AC developing motor on and off in accordance with switching of clutch mechanism, it is possible to ease a shock generated at the start of transmitting rotation drive to a developing cartridge.

In the case where a driving means is a DC developing motor and a shock easing means controls the speed of the DC developing motor in accordance with switching of clutch mechanism, it is possible to ease a shock generated at the start of transmitting rotation drive to a developing cartridge.

Further, in a developing apparatus in use with an image forming apparatus related to another example of the invention, a shock easing means that eases variation of rotation drive is located on the path for transmitting rotation drive from a driving means and located at the downstream side of the source of generating transmission variation. Therefore, design changes are limited to the minimum and thereby a cost increase is restrained, transmission variation such as shocks and vibrations generated in the course of transmission of rotation drive are inhibited and thereby image quality deterioration can be prevented.

In another example of the invention, a shock easing means increases gradually the rotation drive from a low speed to the prescribed speed and thereby eases a shock generated at the start of transmitting rotation drive to a developing cartridge, and it further inhibits vibrations generated in the course of rotation drive. Therefore, transmission variation such as shocks and vibrations generated in the total period of rotation drive are inhibited, resulting in prevention of image quality deterioration caused by pitch unevenness in the sub-scanning direction in the exposure step.

Further, by providing a shock easing member in the vicinity of a coupling gear provided on a drive transmitting means, it is possible to inhibit variations of transmission not only to a developing sleeve but also to other driven factors and thereby to further enhance the inhibition effect.

In addition, by establishing the thickness of a shock easing member depending on the level of rotational load for the developing cartridge, it is possible to achieve the optimum design easily, while in the case where plural projected members are caused to engage with coupling gears on the side of the developing cartridge through the shock easing member for transmission of rotation drive, it is possible to simplify the constitution of the drive transmitting system through the shock easing member and to achieve easy assembling.

Further, when a shock easing member is made of rubber material with hardness of 40°–50° whose main component is silicon, it is possible to inhibit transmission variations such as shocks and vibrations to the utmost.

A member for inhibiting rotational unevenness caused by transmission variation of photoreceptor drum such as a cleaning blade is retreated temporarily in the course of multi-color development. Therefore, it is possible to enhance the effect of inhibiting transmission variation, in particular.

What is claimed is:

1. A developing apparatus for use with an image forming apparatus comprising:

a developing sleeve for rotating and holding toner thereon so as to develop a latent image on an image carrier of said image forming apparatus with said toner;

a driver for generating a rotational driving force;

a drive transmission for transmitting said rotational driving force to said developing sleeve, wherein said drive transmission has a transmitting state and an untransmitting state;

a shock easing device for easing a shock of transmission of said rotational driving force to said developing sleeve in said transmitting state, wherein said shock easing device is provided in at least one of said driver and said drive transmission;

a developing cartridge detachable from said image forming apparatus, wherein said developing sleeve is provided in said developing cartridge;

said shock easing device being provided in said drive transmission, said shock easing device is a shock easing member disposed in said developing cartridge;

said shock easing device being an elastic member, said drive transmission including a pair of coupling gears for transmitting said rotational driving force at a boundary area between said transmission and said developing cartridge, said shock easing member disposed to one of said pair of coupling gears.

2. The apparatus of claim 1, wherein said shock easing member has a size corresponding to a rotary load to said developing cartridge and a plurality of protrusions, and said shock easing member is coupled with said one of said pair of coupling gears through said plurality of protrusions.

3. The apparatus of claim 1 wherein said developing cartridge includes a plurality of different color developing units each having said developing sleeve, said latent image is developed sequentially with each of said plurality of different color developing units so that a multicolor image is formed, said drive transmission includes a clutch mechanism for switching a transmission of said rotational driving force from said driver to said plurality of different color developing units so that said rotational driving force is selectively transmitted to one of said plurality of different color developing units.

4. A developing apparatus for use with an image forming apparatus comprising:

a developing sleeve for rotating and holding toner thereon so as to develop a latent image on an image carrier of said image forming apparatus with said toner;

a driver for generating a rotational driving force;

a drive transmission for transmitting said rotational driving force to said developing sleeve, wherein said drive transmission has a transmitting state and an untransmitting state;

a shock easing device for easing a shock of transmission of said rotational driving force to said developing sleeve in said transmitting state, wherein said shock easing device is provided in at least one of said driver and said drive transmission;

a developing cartridge detachable from said image forming apparatus, wherein said developing sleeve is provided in said developing cartridge;

said shock easing device being provided in said drive transmission, said shock easing device is a shock easing member disposed in said developing cartridge;

said shock easing device being made substantially of a silicon rubber material having a hardness between 40° and 50°.

5. The apparatus of claim 4, wherein said developing cartridge includes a plurality of different color developing units each having said developing sleeve, said latent image is developed sequentially with each of said plurality of different color developing units so that a multicolor image is formed, said drive transmission includes a clutch mechanism for switching a transmission of said rotational driving force from said driver to said plurality of different color developing units so that said rotational driving force is selectively transmitted to one of said plurality of different color developing units.

6. A developing apparatus for use with an image forming apparatus comprising:

a developing sleeve for rotating and holding toner thereon so as to develop a latent image on an image carrier of said image forming apparatus with said toner;

a driver for generating a rotational driving force;

a drive transmission for transmitting said rotational driving force to said developing sleeve, wherein said drive transmission has a transmitting state and an untransmitting state;

a shock easing device for easing a shock of transmission of said rotational driving force to said developing sleeve in said transmitting state, wherein said shock easing device is provided in at least one of said driver and said drive transmission;

a developing cartridge detachable from said image forming apparatus, wherein said developing sleeve is provided in said developing cartridge;

said shock easing device being provided in said drive transmission, said shock easing device is a shock easing member disposed in said developing cartridge;

said drive transmission including a pair of coupling gears for transmitting said rotational driving force at a boundary area between said transmission and said developing cartridge, said shock easing member disposed to one of said pair of coupling gears, said shock easing member has a size corresponding to a rotary load to said developing cartridge and a plurality of protrusions, and said shock easing member is coupled with said one of said pair of coupling gears through said plurality of protrusions.

7. A developing apparatus for use with an image forming apparatus comprising:

a developing sleeve for rotating and holding toner thereon so as to develop a latent image on an image carrier of said image forming apparatus with said toner;

a driver for generating a rotational driving force;

a drive transmission for transmitting said rotational driving force to said developing sleeve, wherein said drive transmission has a transmitting state and an untransmitting state;

a shock easing device for easing a shock of transmission of said rotational driving force to said developing sleeve in said transmitting state, wherein said shock easing device is provided in at least one of said driving device and said drive transmission;

a developing cartridge detachable from said image forming apparatus, wherein said developing sleeve is provided in said developing cartridge;

said shock easing device being provided in said drive transmission, said shock easing device is a shock easing member disposed in said developing cartridge;

said shock easing device being an elastic member.

* * * * *